United States Patent [19]

Miller

[11] Patent Number: 4,936,046

[45] Date of Patent: Jun. 26, 1990

[54] HORTICULTURAL TRANSPORT RECEPTACLE

[76] Inventor: Suzanne L. Miller, 2111 Wallace Ave., Aptos, Calif. 95003

[21] Appl. No.: 461,113

[22] Filed: Jan. 4, 1990

[51] Int. Cl.[5] ..... B65D 85/50

[52] U.S. Cl. ..... 47/41.01; 47/84; 206/423

[58] Field of Search ..... 47/84, 41.01, 41.12, 47/41.11; 206/423

[56] References Cited

U.S. PATENT DOCUMENTS 3,973,356 8/1976 Schacht ..... 47/41.01

FOREIGN PATENT DOCUMENTS 0319445 6/1989 European Pat. Off. ..... 206/423

2923455 12/1980 Fed. Rep. of Germany ..... 47/41 R

89/05270 6/1989 PCT Int'l Appl. ..... 206/423

*Primary Examiner*—David A. Scherbel

*Assistant Examiner*—Jerrold D. Johnson

*Attorney, Agent, or Firm*—Jeffrey A. Hall

[57] ABSTRACT

A receptacle for the transport, storage and display of horticultural articles includes a base, an inner receptacle, an insert element, a side element, and a cover element. The inner receptacle is slidable within the base and the insert element is slidably encompassed by the inner receptacle. The side element is telescopically slidable over the inner receptacle and the cover element slidably fits over the side element. The insert element may have a hydrophillic lining to maintain moisture and humidity. The receptacle functions as a display vase when the side element and the cover element are removed.

4 Claims, 1 Drawing Sheet

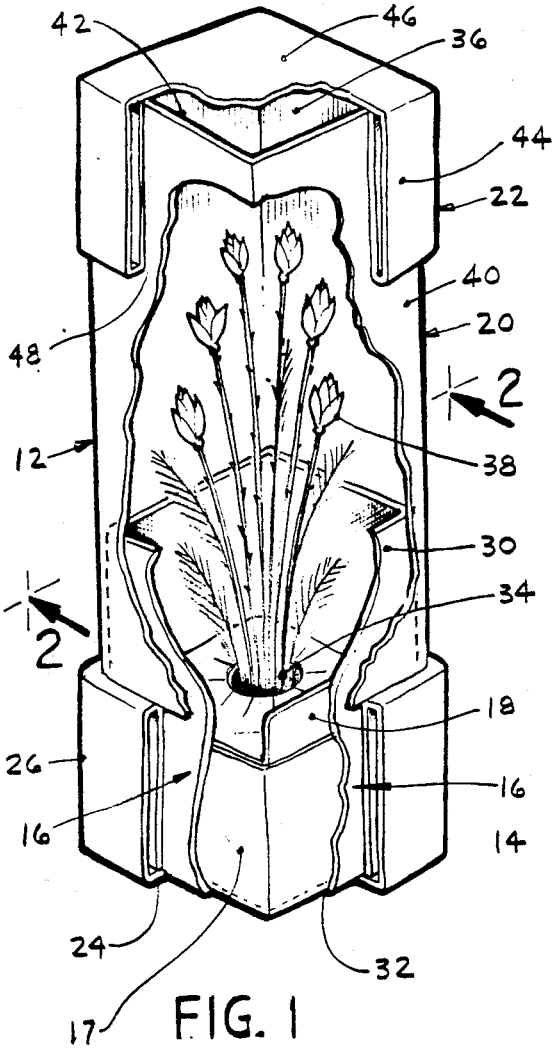
FIG. 1
FIG. 2-2
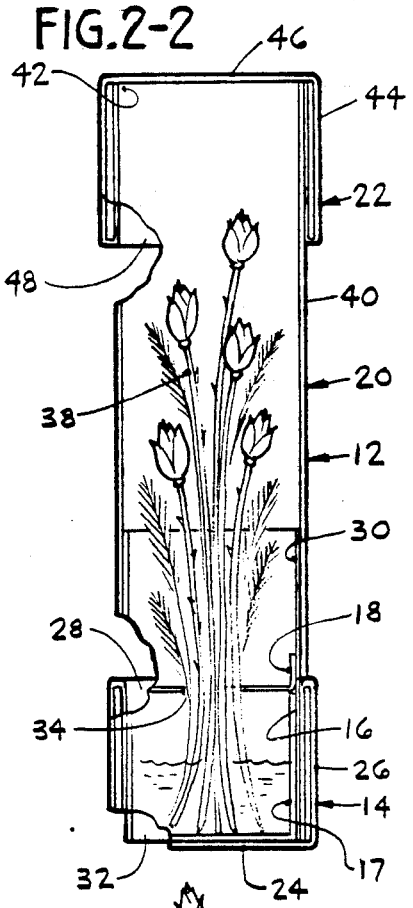
FIG. 3
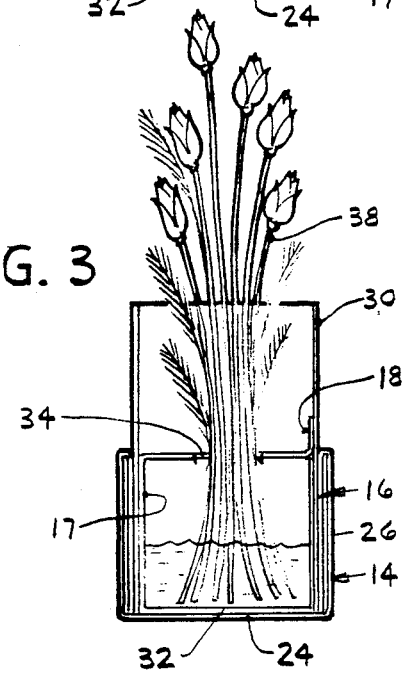

HORTICULTURAL TRANSPORT RECEPTACLE

BACKGROUND OF THE INVENTION

1. Field of Invention

The present invention related to transport receptacles for horticultural items, especially to receptacles for use in shipping cut flowers which convert to a vase when opened.

2. Description of the Prior Art

Shippers and florists have traditionally provided limited protective measures for the transport of horticultural items, in particular cut flowers and other consumer oriented items. Typically the receptacles and wrappings of the prior art included various sheets conventionally wrapped around the item. Such methods of transport severely limit the distance and means available for transporting perishable and fragile items such as cut flowers. Furthermore after delivery a separate vase must be located to place and store the flowers in. This presents difficulties when, for instance, the flowers are sent to businesses or hospitals where such items are not readily or conveniently available.

Heretofore a wide variety of transport receptacles have been proposed and implemented for transporting horticultural items.

One such receptacle is disclosed in U.S. Pat. No. 3,973,356 to Schact wherein a caddy providing a protective disclosure for the delivery and display of house plants and cut flowers is shown. The caddy comprised a cover telescopically slidable over a receptacle with the height being adjusted by a harness which is extendable through registration slots in the receptacle. This type of receptable is of limited applicability due to the difficulty of shipping a container with a loose external harness. Furthermore, such receptacle did not provide for interior humidity or aeration which is essential for maintaining cut flowers and other horticultural items in optimum condition.

Another type of receptacle for shipping horticultural commodities is shown in U.S. Pat. No. 4,071,064 to Saul. This type of receptacle relates to containers with axial extending side walls which provide means for receptacle.

Other pertinent prior art known to applicant are U.S. Pat. Nos. 1,270,554 and 3,127,011 which disclose receptacles of selected lengths for holding particular flowers. These patents do not have means by which to convert the box into a vase nor do they provide means to control interior humidity and air flow. Furthermore, such packaging arrangements require a sufficient inventory of different length boxes which must always be kept on hand. Such limitations have undoubtedly been a reason these receptacles have not received widespread acceptance.

Most shippers and florists, therefore, would find it desirable to have a receptacle which is adaptable to a wide range of flowers and other horticultural items, which provide means to control interior humidity and air flow, and which is convertable to an attractive stable vase when opened.

SUMMARY OF THE INVENTION

Therefore it is the object of the present invention to provide a shipping and packing means which overcomes the limitations of the prior art and which is adaptable to a wide range of flowers and other horticultural items while providing means to control interior humidity and air flow, and which, when opened, converts into an attractive stable vase for the contents therein.

The horticulture transport receptacle of this invention is constructed of a base, an inner receptacle component which fits slidably within the base and includes an insert for securing cut flowers or other horticultural items. An elongated side element fits slidably over the inner receptacle, and a cover element fits slidably over an upper section of the side element. The components are slidably positionable relative to one another to provide a receptacle which is stable and secure and is opened simply by sliding the cover and side elements off the inner receptacle and base. The fastening together of the individual components is by frictional or surface interactions therebetween.

Having thus summarized the invention it will be seen that an object thereof is to provide a transport receptacle for horticultural items which, when opened, converts into an attractive display vase for cut flowers and other horticultural items.

Specifically, it is an object of the present invention to provide a receptacle suitable for use in the mails having slidable elements slidably secured to one another which is easily opened and convertable into a stable display vase for cut flowers.

Another object of the invention is to provide a receptacle which stably secures the contents transported therein regardless of how it is placed or positioned.

It is a further object of the invention to provide a receptacle for shipping flowers and other horticultural items, which provides means to control interior humidity and air flow, and which is easy to use, manufacture and store.

These and other objects, features, and advantages will be apparent from the following description of the preferred embodiment when considered in connection with the accompanying drawings.

BRIEF DESCRIPTION OF THE DRAWINGS

FIG. 1 is a perspective view of a horticultural transport receptacle of this invention.

FIG. 2 is a longitudinal sectional line taken along line 2—2 of FIG. 1.

FIG. 3 is a sectional view similar to FIG. 2 with the lower and side element removed; the inner receptacle and base serves as a vase for display of flowers.

DESCRIPTION OF THE PREFERRED EMBODIMENT

FIG. 1 shows a horticultural transport receptacle 12 according to the preferred embodiment of the invention. The receptacle 12 is designed for the transport, storage, and display of cut flowers and other horticultural items. The receptacle 12 is especially adaptable for providing a protective housing during delivery by mail or courier of cut flowers from a florist or other source to a customer. The receptacle 12 protects the flowers from damage and dedication so that the flowers are delivered undamaged, unwilted, and unfaded. The receptacle 12 of this invention is also provided with an integral vase which, upon opening the receptacle, presents the contents in a stable, attractive, and celebratory manner..

The receptacle 12 is constructed from an essentially semi-rigid material shown as substantially rectangular and includes five interfitting elements, a base 14, an inner receptacle 16, an insert element 18, a side element 20, and a cover element 22. Base 14 is closed at a lower margin 24 and includes an upright wall portion 26 defining access opening 28, Inner receptacle 16 includes an upright wall portion 30, a bottom access opening 32, and an upper access opening 34. Slidably received within inner receptacle 16 is insert element 18 with opening 36 for receiving and supporting cut flowers 38 or other horticultural articles therein. Insert element 18 may be lined with a hydrophillic lining 17 so as to maintain humidity and moisture within the receptacle.

Side element 20 includes substantially planar walls 40 and is closed at an upper margin 42. Cover element 22 includes walls 44, and is closed at an upper margin 46 and an access opening 48.

In another embodiment the cover 16 may be eliminated and side element 20, being closed at an upper margin 42, serves as top to the receptacle 12.

FIG. 2 illustrates how individual elements are slidably connected to one another without straps, adhesives, or other fastening means in the preferred embodiment. FIG. 3 shows side element 20 and cover element 22 removed, with base 14, inner receptacle 16 and insert element 18 serving as a water reservoir and vase for the display of flowers 38.

The receptacle 12 of FIGS. 1, 2, and 3 will perform a wide variety of transport, storage, and display functions, but users will find it most useful for the transport and shipping of flowers and the like.

To transport flowers, the stem portions of the flowers 38 are first placed in insert element 18. Insert element 18 is then gently slid into inner receptacle 16, and then both the insert element 18 and inner receptacle 16 are slid into base 14. Side element 20 is slid into alignment with base 14 and then cover element 22 is slid over side element 20 (see FIG. 2).

After delivery of the receptacle 12 cover element 22 and side element 20 can be discarded and the base 14, inner receptacle 16 and insert element 18 may be used as a vase (see FIG. 3). Water may be added to hydrophillic lining 17 to maintain moisture and humidity if necessary.

While the above description contains many specifics, the reader should not construe these as limitations on the scope of the invention, but merely as exemplifications of preferred embodiments thereof. Those skilled in the art will envision many other possible variations are within its scope. Accordingly the reader is requested to determine the scope of the invention by the appended claims and their legal equivalents and not by the examples which have been given.

I claim:

1. A receptical for transporting horticultural items comprising in combination:

a base closed at a lower margin and having an upright wall portion and an access opening, an inner receptacle having an upright wall portion a bottom access opening and an upper access opening, being adapted to be slidably received in said base, an insert element having an opening for receiving flowers or other horticultural items therein and being adapted to be slidably received in said inner receptacle said insert element having a hydrophillic lining, a side element having substantially planar walls, said side element being adapted to slidably encompass said inner receptacle, and a cover element having walls and being closed at an upper margin and having an access opening for slidably encompassing said side element.

2. The receptacle of claim 1 wherein the receptacle is composed of semi-rigid material.

3. A receptical for transporting flowers comprising in combination:

a base closed at a lower margin and having an upright wall portion and an access opening, an inner receptacle having an upright wall portion a bottom access opening and an upper access opening, being adapted to be slidably received in said base, an insert element having an opening for receiving flowers or other horticultural items therein and being adapted to be slidably received in said inner receptacle, said insert element having a hydrophillic lining, and a side element having upright walls and being closed at an upper end, said side element being adapted to slidably encompass said inner receptacle.

4. The receptacle of claim 3 wherein the receptacle is composed of semi-rigid material.

* * * * *